US009254405B1

(12) United States Patent
Marji

(10) Patent No.: US 9,254,405 B1
(45) Date of Patent: Feb. 9, 2016

(54) VARIABLE RESISTANT EXERCISE BAND, DEVICE CONTAINING SAME AND EXERCISE METHOD

(76) Inventor: Sammy Black Marji, Yonkers, NY (US)

( * ) Notice: Subject to any disclaimer, the term of this patent is extended or adjusted under 35 U.S.C. 154(b) by 247 days.

(21) Appl. No.: 12/927,854

(22) Filed: Nov. 29, 2010

(51) Int. Cl.
*A63B 21/02* (2006.01)
*A63B 21/055* (2006.01)

(52) U.S. Cl.
CPC ..... *A63B 21/02* (2013.01); *A63B 21/055* (2013.01)

(58) Field of Classification Search
CPC ..... A63B 21/0552; A63B 21/0555; A63B 21/0557; A63B 21/02
USPC ..... 482/91, 125, 126, 92, 121–124, 129, 482/130, 39–40
See application file for complete search history.

(56) References Cited

U.S. PATENT DOCUMENTS

| | | | | | |
|---|---|---|---|---|---|
| 1,922,566 | A * | 8/1933 | Brand | 607/78 |
| 3,838,852 | A * | 10/1974 | Gury | 482/125 |
| 3,912,266 | A * | 10/1975 | Gury | 482/125 |
| 4,033,580 | A * | 7/1977 | Paris | 482/122 |
| 4,059,265 | A * | 11/1977 | Wieder et al. | 482/125 |
| 5,125,649 | A * | 6/1992 | Fuller | 482/123 |
| 5,282,777 | A * | 2/1994 | Myers | 482/122 |
| 5,496,245 | A * | 3/1996 | Du Verney | 482/126 |
| 5,518,481 | A * | 5/1996 | Darkwah | 482/126 |
| 5,707,324 | A * | 1/1998 | Blake | 482/124 |
| 5,720,699 | A * | 2/1998 | Musachio et al. | 482/122 |
| 6,036,625 | A * | 3/2000 | Woodruff | 482/121 |
| 6,241,644 | B1 * | 6/2001 | Tepperberg | 482/121 |
| 6,322,483 | B1 * | 11/2001 | Rotella | 482/129 |
| 6,726,606 | B2 * | 4/2004 | Jacobsen | 482/121 |
| 6,840,894 | B2 * | 1/2005 | Lerner | 482/124 |
| 6,908,418 | B2 * | 6/2005 | Saure | 482/121 |
| 7,090,627 | B1 * | 8/2006 | Walker | 482/140 |
| 7,326,157 | B2 * | 2/2008 | Wu | 482/126 |
| 7,494,450 | B2 * | 2/2009 | Solomon | 482/69 |
| 7,743,656 | B1 * | 6/2010 | Dickinson et al. | 73/379.01 |
| 7,744,512 | B2 * | 6/2010 | Clarke | 482/124 |
| 7,805,816 | B1 * | 10/2010 | Thorne et al. | 24/301 |
| 7,922,634 | B1 * | 4/2011 | Wu | 482/126 |
| 8,002,681 | B2 * | 8/2011 | Kopp | 482/124 |
| 8,303,471 | B2 * | 11/2012 | Musachio | 482/121 |
| 2002/0103059 | A1 * | 8/2002 | Kushner | 482/126 |
| 2005/0113223 | A1 * | 5/2005 | Dovner et al. | 482/121 |
| 2005/0239617 | A1 * | 10/2005 | Tenaglia | 482/122 |
| 2007/0004571 | A1 * | 1/2007 | Gonzalez | 482/124 |
| 2007/0207905 | A1 * | 9/2007 | Winston | 482/126 |
| 2007/0287614 | A1 * | 12/2007 | Fuller | 482/121 |
| 2008/0009398 | A1 * | 1/2008 | Grisdale | 482/124 |
| 2008/0058180 | A1 * | 3/2008 | Clarke et al. | 482/126 |
| 2008/0132392 | A1 * | 6/2008 | Moulton | 482/122 |
| 2008/0300117 | A1 * | 12/2008 | Madden | 482/126 |
| 2009/0075789 | A1 * | 3/2009 | Hetrick | 482/91 |
| 2009/0137371 | A1 * | 5/2009 | Fuller | 482/122 |
| 2009/0176634 | A1 * | 7/2009 | Wu | 482/122 |
| 2009/0275449 | A1 * | 11/2009 | Terry | 482/139 |
| 2010/0113231 | A1 * | 5/2010 | Kopp | 482/124 |
| 2011/0207585 | A1 * | 8/2011 | Burns | 482/124 |

* cited by examiner

*Primary Examiner* — Stephen Crow
*Assistant Examiner* — Andrew S Lo

(57) ABSTRACT

An exercise device is provided using a variable resistant exercise band having spaced apart eyelets along the length of the band. Each eyelet located at respective ends of the band is secured onto a hook member attached to a rigid bar, or a grip handle which permits the band to be pulled up to different levels, or in different directions.
A method is also provided for using the exercise device.

2 Claims, 7 Drawing Sheets

10
21
19
11
13
13
13
13
29

10
13
27
11
13
13
13
13
13
29

3
11
13
11
3

11
13
11

FIG. 9
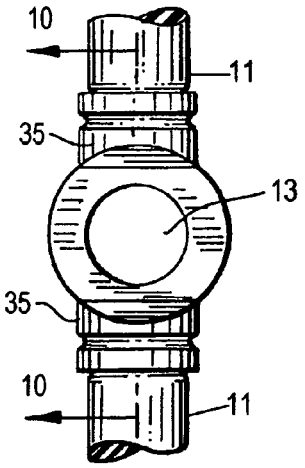
FIG. 7
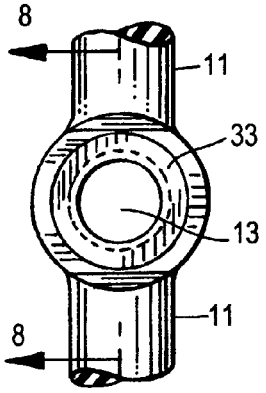
FIG. 8
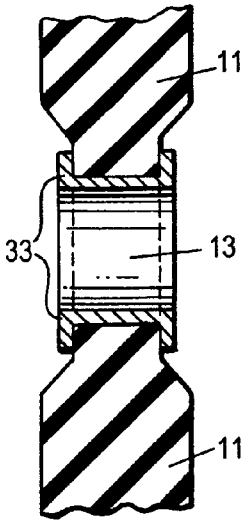
FIG. 10
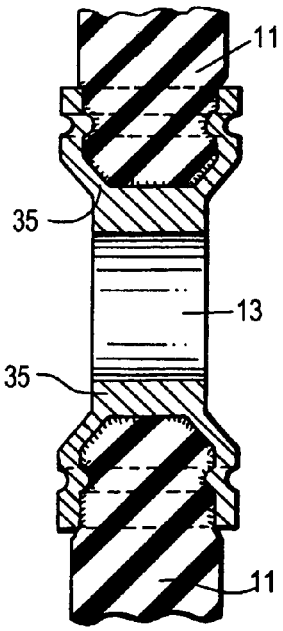
FIG. 11
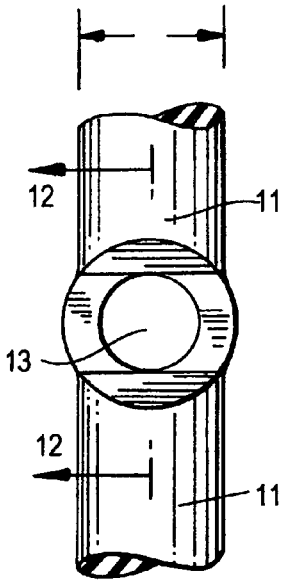
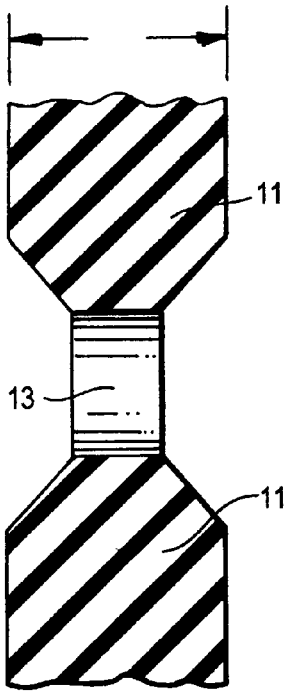
FIG. 12

FIG. 13
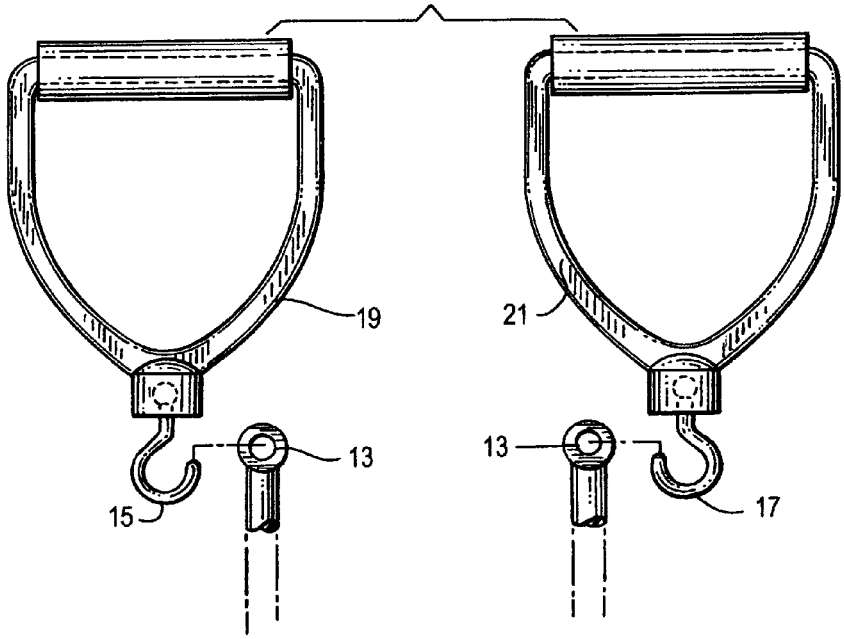
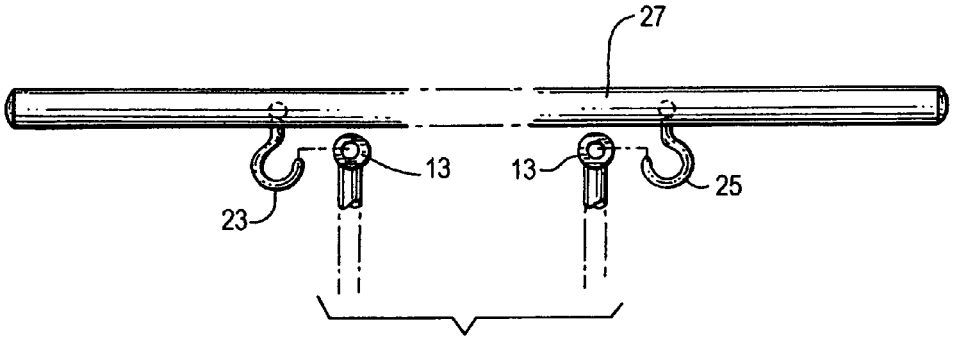
FIG. 14

VARIABLE RESISTANT EXERCISE BAND, DEVICE CONTAINING SAME AND EXERCISE METHOD

FIELD OF THE INVENTION

The present invention relates generally to an exercise device and is particularly related to an exercise device comprising a variable resistant band or elongated elastic tubular member which can be manipulated by the hands of an exerciser during exercises. The invention also relates to an exercise method using the device of this invention.

BACKGROUND OF THE INVENTION

It is a matter of common experience that a variety of exercise devices have been developed in recent years and have been commonly used in various health clubs, gyms, and even at home. This is largely due to increased emphasis on individual physical fitness and public health awareness. Indeed views who watch regular television as well as commercial telephone programs have undoubtedly noticed the numerous and diverse types of exercise apparatus and devices, both simple and complicated, with various claims of the advantages resulting from their daily use. Also, over the years, there have been numerous patents and publications disclosing and featuring various exercises devices. One such exercise device was disclosed in U.S. Pat. No. 3,369,809 issued Feb. 20, 1968 which describes an exercise device useful for isometric and isotonic exercises. The device comprises a platform upon which the exerciser stands and a pair of ropes each having one end journalled for rotation about a pulley on the platform and a free end connected to a handle which can be grasped by the user for pulling up the rope.

Another and somewhat similar exercising device is disclosed in U.S. Pat. No. 3,843,719 issued Oct. 23, 1974.

U.S. Pat. No. 4,26,708 issued Apr. 27, 1982 discloses an elastic cable exerciser with an improved bar.

U.S. Pat. No. 3,195,835 issued Apr. 1, 1984 discloses an elastic cable exerciser.

Publication No. US 2007/0207903 A1, dated Sep. 6, 2007 discloses a tension-type exercise device such as a cord, band, tube or loop, made of an expanded elastomer material.

Publication No. US 2008/0009398 A1 dated Jan. 10, 2008 discloses an exercise device comprising a flexible band in form of a closed loop and at least one tension adjuster for adjusting the tension on the loop.

Notwithstanding the variety of available exercise devices, there is still a dire need for an exercise device which permits the exerciser to readily vary the tension and resistance of the device during exercise.

Therefore, it is an object of the present invention to provide an exercise device which comprises a variable resistant band which can be readily manipulated by the exerciser during exercise.

It is also an objection of this invention to provide an exercise device which is adapted for various exercises such as isometric exercises and isotonic exercises.

It is a further object of this invention to provide such exercise devise which is adapted to be used in home and is readily portable from one place to another.

The foregoing and other objects and features of this invention will be more readily understood from the ensuing detailed description of the invention and the drawings which for parts of the application.

SUMMARY OF THE INVENTION

In accordance with this invention an exercise device comprises an elongated variable resistant elastic or tension band having a plurality of spaced apart eyelets located along the length of the band, preferably equidistantly from each other. Usually six to eight such eyelets are provided although the number of eyelets may be varied if desired by the exerciser.

In one embodiment a rigid bar is provided which is adapted to be gripped by the hands of the exerciser. A hook member such as an S-hook is rotatably secured at each end of the resistant bar for securely engaging an eyelet onto the hook member. Each terminal eyelet of said band is secured onto the hook at each end of said rigid bar thus permitting the exerciser to pull the band to different heights or direction, with both hands or with one hand at a time if so desired.

In another embodiment, each terminal eyelet is secured to a hook member rotatably attached to a grip handle, one to be gripped by the left hand and the other to be gripped by the right hand. The exerciser can then pull the band to different heights or directions using both hands or one hand if so desired.

By engaging different eyelets of the bands onto the hook member, the exerciser changes the resistance or tension of the band and thus increases or decreases the force required during the exercise.

BRIEF DESCRIPTION OF THE DRAWINGS

In the drawings, wherein like reference numerals designate like parts:

FIG. 7 is a front elevational view showing the eyelet used with a metal grommet to give it greater wear;

FIG. 8 is a cross-sectional view taken along the lines 8-8 of FIG. 7;

FIG. 9 is a front elevational view of another embodiment showing the eyelet made totally from metal and the elastic tension lines glued and crimped into place;

FIG. 10 is a cross-sectional view taken along the lines 10-10 of FIG. 9 showing how the plastic lines are secured to the eyelet;

FIG. 11 is a view similar to FIG. 2 showing the elastic band made of a thicker material which gives a greater tension to the band during exercise;

FIG. 12 is a cross-sectional view taken along the lines 12-12 of FIG. 11;

FIG. 13 is a partial exploded view showing each handle with its rotatably attached S-hook and further illustrating how each of the hooks engages the eyelet on the elastic band;

FIG. 14 is a partial exploded view of a rigid bar with a pair of spaced apart S-hooks and showing how the eyelets engage the S-hooks attached to the rigid bar;

DETAILED DESCRIPTION OF THE INVENTION

Figures 1, 2, 3, 4:
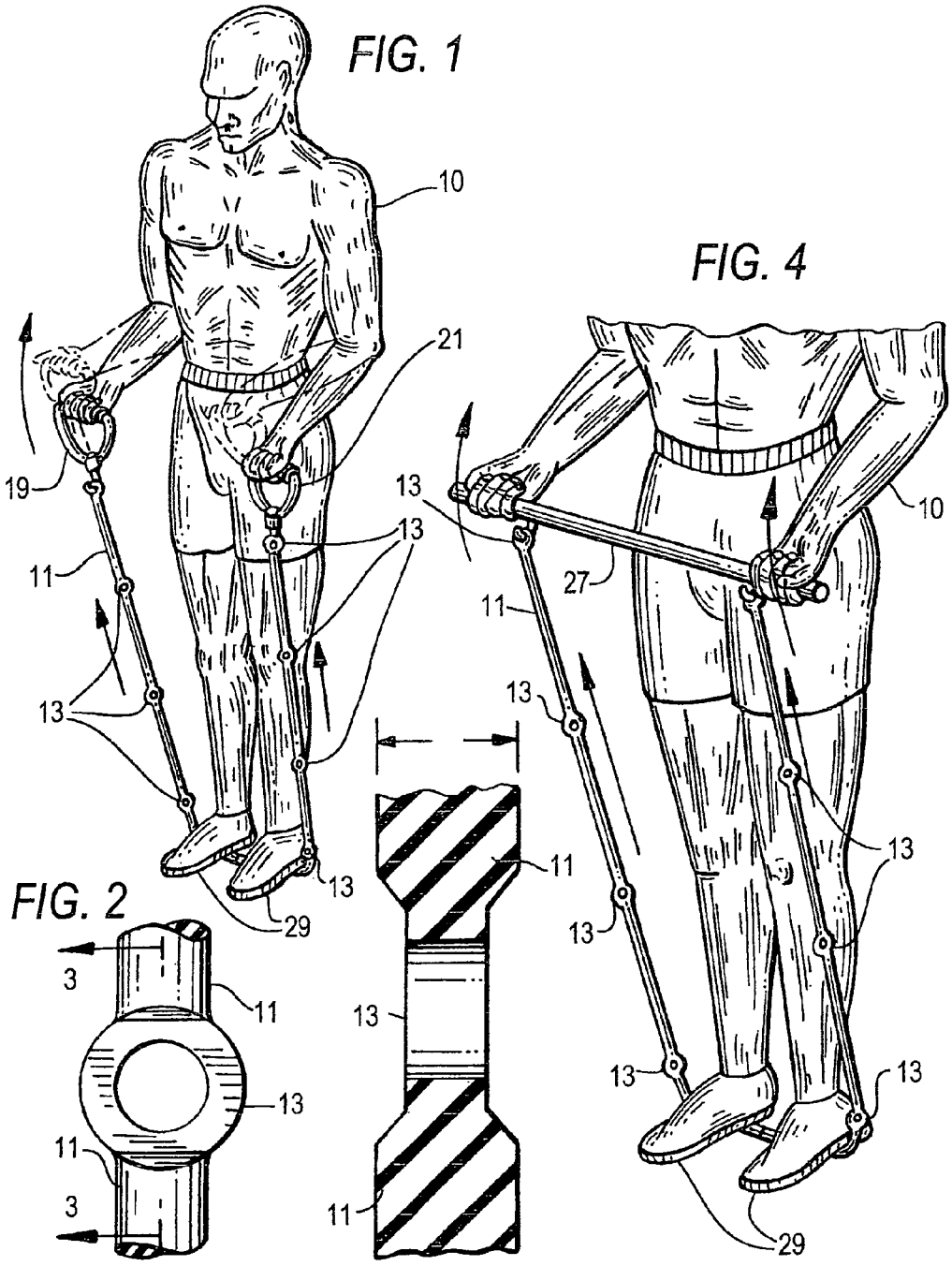
FIG. 1 is a perspective view illustrating an exerciser using the variable band of the device of this invention.
FIG. 2 is a view of one of the several eyelets which are secured along the variable resistant band shown in FIG. 1.
FIG. 3 is a sectional view taken along the lines 3-3 of FIG. 2.
FIG. 4 is a perspective view similar to FIG. 1 but wherein the upper ends of the variable resistant band are secured to S-type hooks attached to the ends of a rigid horizontal bar.
Figure 5:
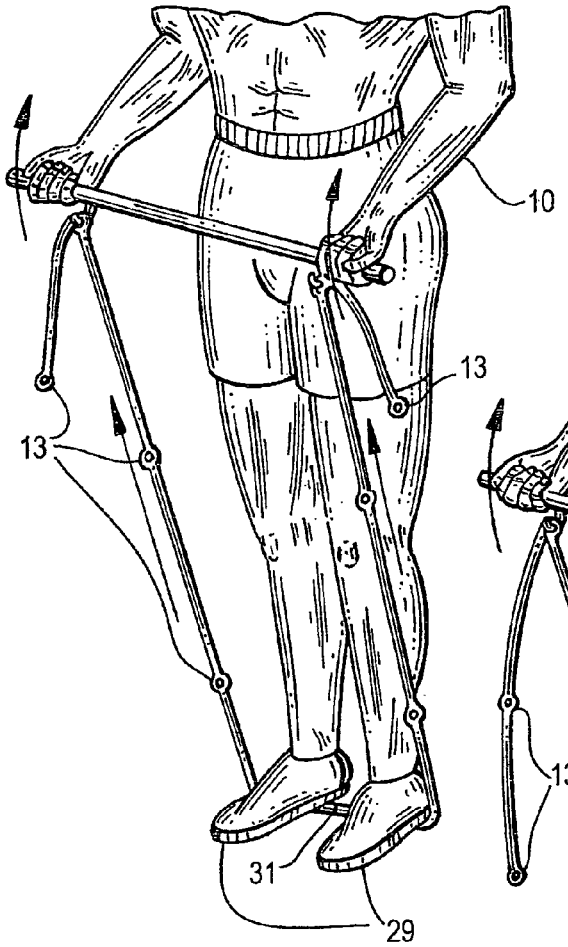
FIG. 5 is a partially perspective view of an exerciser showing how the tension of the variable resistant band is increased by securing the eyelet onto the S-hook of the rigid horizontal bar.
Figure 6:
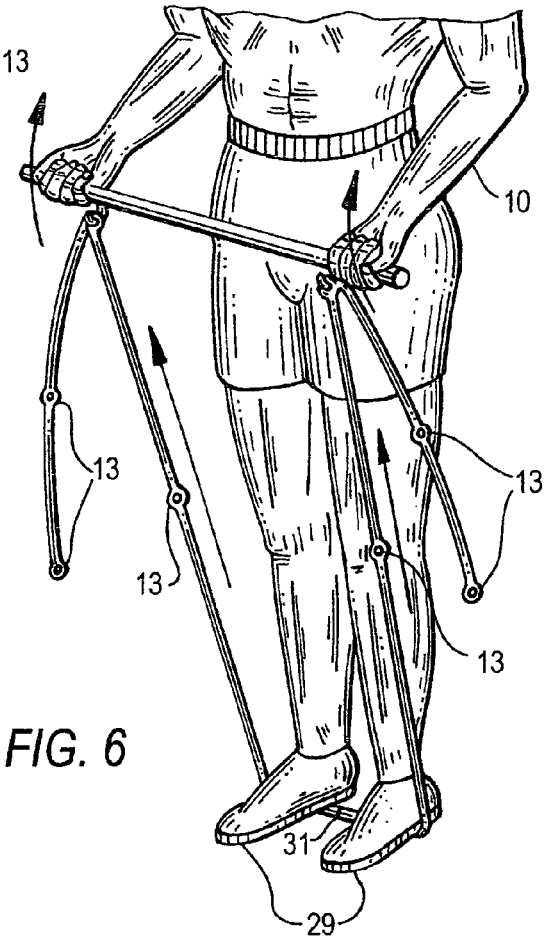
FIG. 6 is a view similar to FIG. 5 but showing the next adjacent eyelet is retained by the S-hook of the rigid horizontal bar.

Referring to the drawings there are shown in FIGS. 1, 4, 5 and 6, exerciser 10 using the resistant band 11 which may be in the form of an elastic band or tube having variable resistance and tension when manipulated by the exerciser. A plurality of spaced apart eyelets 13 are secured along the band 11 and are secured by metal connectors (grommets) 33,35 as shown in FIGS. 7 and 8. In the embodiments shown in said figures six (6) eyelets are secured in the bands and spaced equidistantly although the number of eyelets may vary, if desired, depending on the height of the resistant band 11, but usually 4 to 8 eyelets may be used which can be spaced apart along the band. In FIG. 1, the uppermost eyelets are rotatably secured to S-hooks 15,17 of handles 19,21 (see FIGS. 1 and 13) or S-hooks 23,25 rotatably attached to a rigid bar 27 (see FIGS. 4 and 14). As shown in FIGS. 1, 2, 5 and 6, the exerciser places the band 11 on the floor beneath his feet 29, literally stepping on the band with the center bead 31 of the band midway on the band 11 below the exerciser's feet 29. With the band 11 firmly in place under the exerciser's feet 29, the exerciser grips the handles 19,21 (see FIG. 1) or the rigid bar 27 (see FIG. 2) and pulls the band 11 upward as high as desired during exercise.

Figure 15:
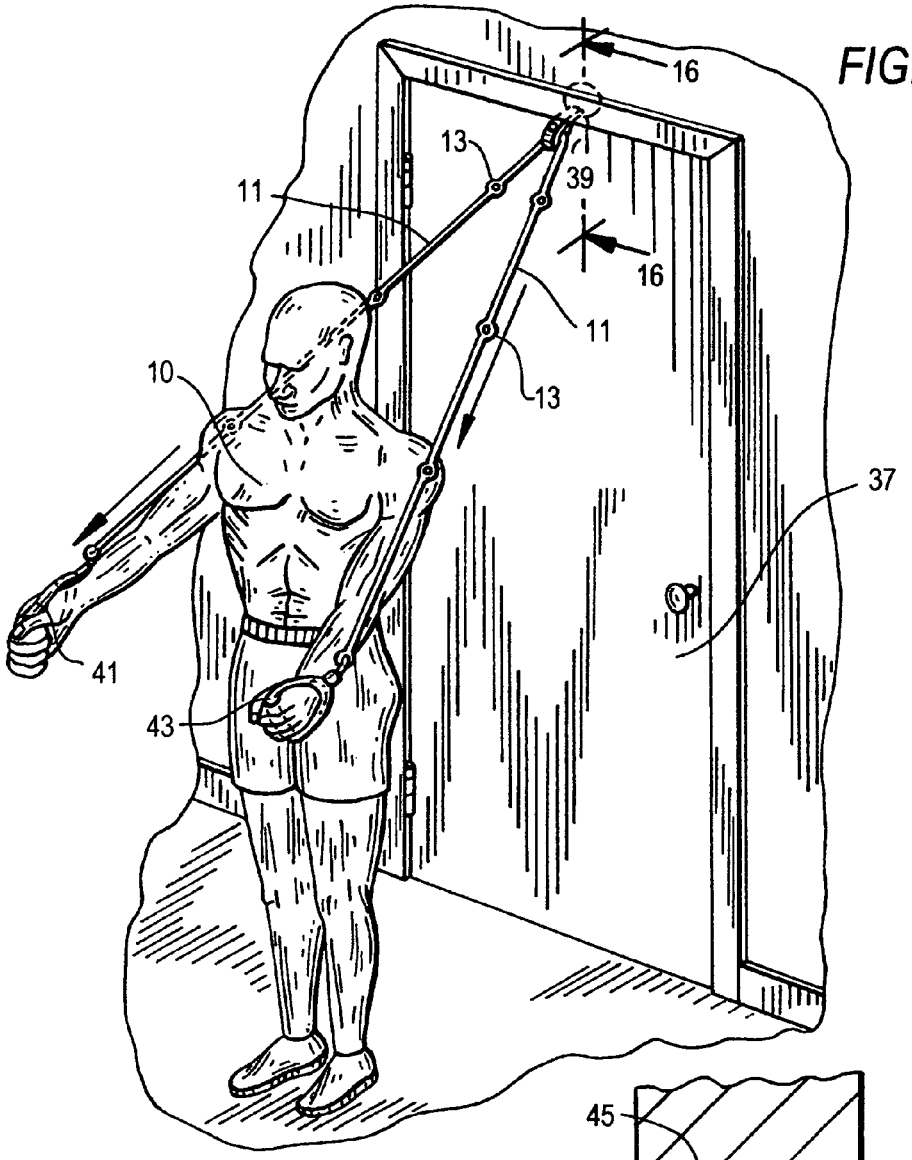
FIG. 15 is a perspective view of an exerciser using a variable elastic band secured to the top of a door by means of an adapter.
Figure 16:
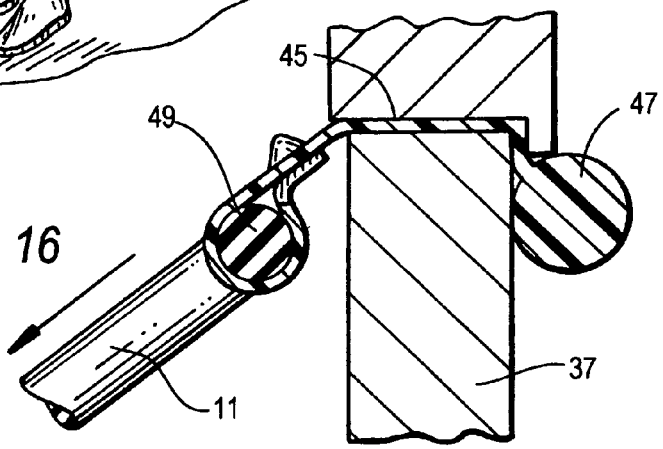
FIG. 16 is a cross-sectional view taken along the lines 16-16 of FIG. 15 showing how the elastic band is secured to the door in place by the adapter.
Figure 17:
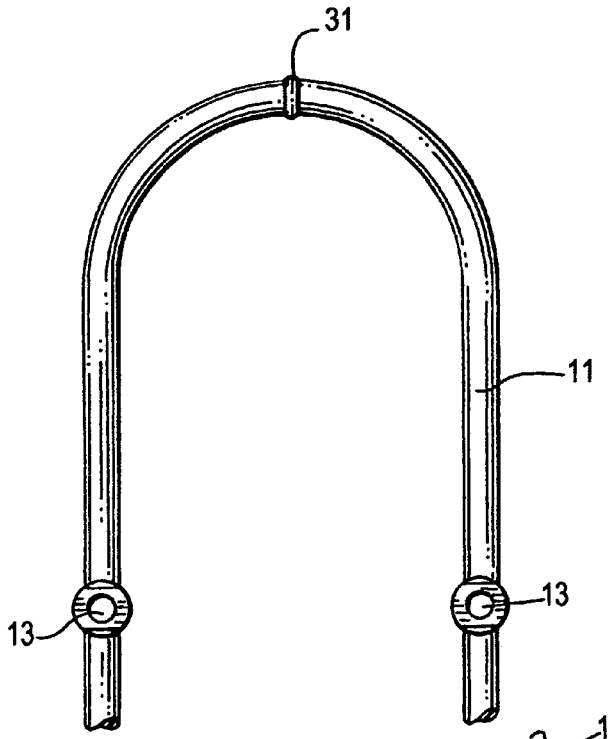
FIG. 17 is a partial elevational view showing the central portion of the band having a central bead attached to permit the exerciser to know location of the center of the band.
Figure 19:
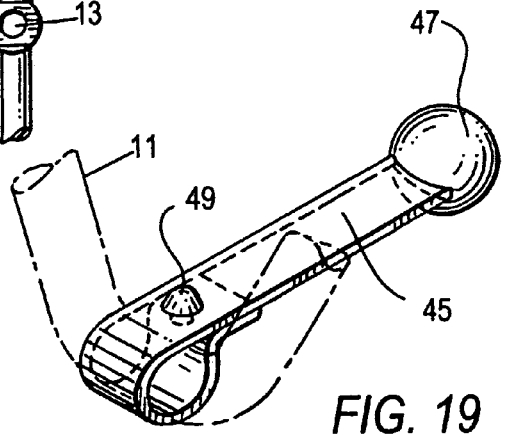
FIG. 19 is a perspective view of the adapter shown in FIG. 18 during its use, in closed position.
Figure 18:
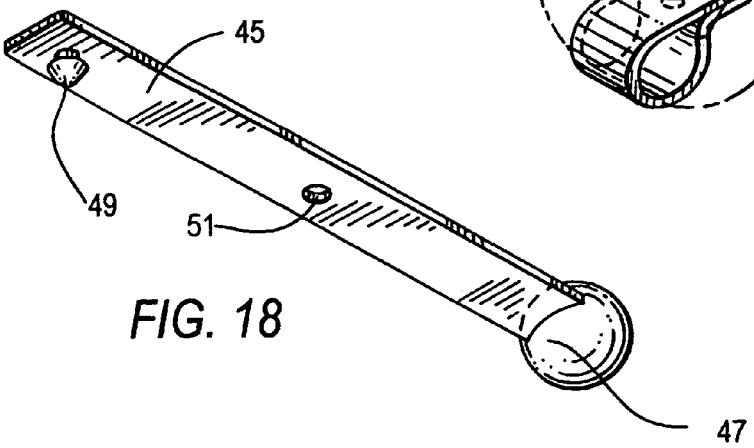
FIG. 18 is a perspective view of the adapter strap in open position.

In order to change the resistance of the band 11 so as to require greater force by the exerciser, the band is pulled up so as to engage the next (lower) eyelet 13 which is hooked onto the S-hook, shortening the effective length of the resistant band 11 and thus requiring greater force by the exerciser to pull up the band. The resistance of the band 11 may be further increased by engaging the next lower eyelet 13 into the S-hook 15, or S-hook 17, or both hooks as desired, The resistant band of the present invention is adapted for exercise methods other than the exercise described and illustrated in connection with FIGS. 1, 2, 5 and 6. Thus referring to FIGS. 15 and 17, it can be seen that the resistant band of this invention may be used for different exercise methods. In FIG. 15, the resistance band 11 is affixed to the top of a door 37 by means of an adapter 39 which is shown in more detail in FIG. 16. The exerciser 10 grips the handles 41,43 at each end of the band 11 and pulls the band 11 forward to work a different set of the exerciser's muscles. FIG. 16 shows how the elastic band 11 is held in place by the adapter strap 45 which terminates at its end with a metallic or plastic restraining ball 47 placed on the other side of the door 37. The elastic band 11 is secured in place by the closure snap 49. FIG. 18 is a perspective view showing the adapter strap in its open position, the restraining ball 47 at the end of the adapter strap with the closure snap 49 and snap hole 51. The adapter strap is shown in FIG. 19 in closed position.

Figure 20:
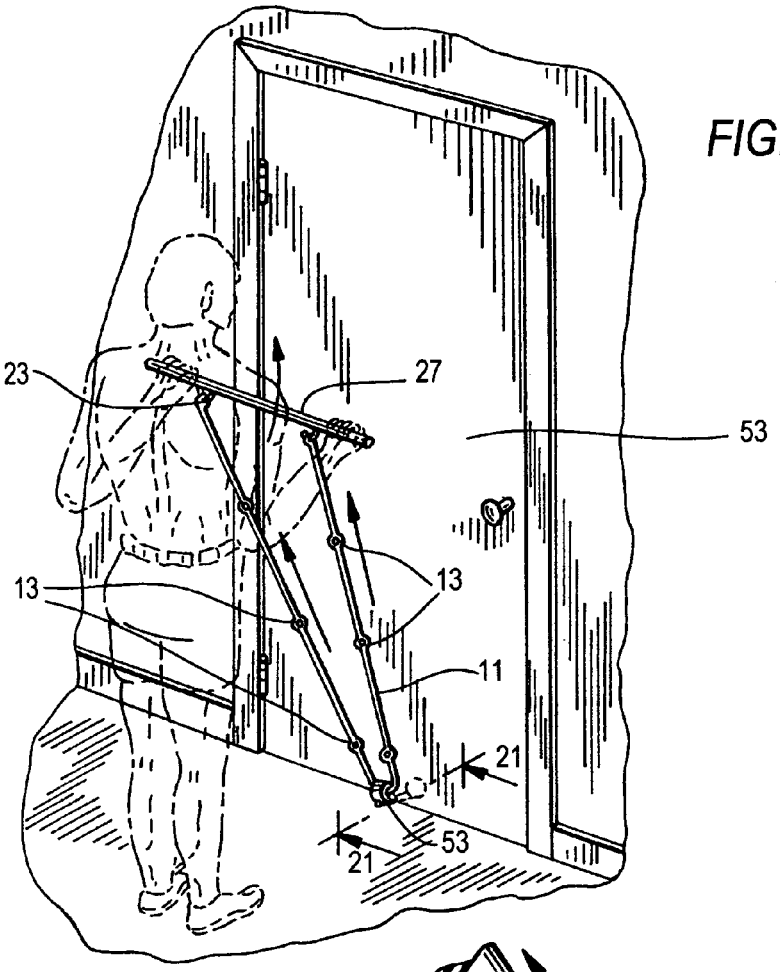
FIG. 20 is a perspective view of an exerciser using the variable resistant band secured to the bottom of a door by an adapter as in FIG. 19.
Figure 21:
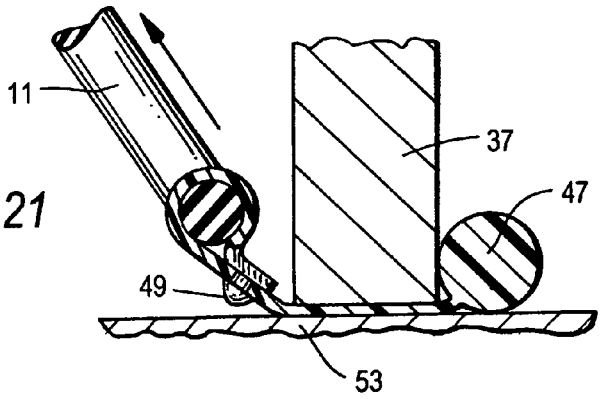
FIG. 21 is a cross-sectional view taken along the lines 21-21 of FIG. 20.

Another variation of an exercise method using the resistant band of the present invention is illustrated in FIG. 20. In this figure, the lower end of the resistant band 11 having spaced apart eyelets 13 is affixed to the bottom of the door 53 by means of the adapter strap 45 and the upper ends of the band are secured to the S-hooks 23,25 which are rotatably attached to the rigid bar 27. In this embodiment, the exerciser faces the exercise band 11 and pulls the band to any desired level in order to exercise different muscles than those used in the exercise method shown in FIG. 15 and FIGS. 1, 2, 5 and 16.

As it can be appreciated from the foregoing disclosure, the resistant band with its multiple spaced apart eyelets provides a simple, yet effective exercise method, and a device which is readily portable for use in different locations. The exercise devise may be safely used by both men and women and can be adjusted for individuals having different strengths.

The invention claimed is:

1. An exercise device comprising an elongated variable resistant band adapted to be stood upon by an exerciser, a rigid bar having two ends, a grip handle at each end configured to be gripped by hands of the exerciser, an S-hook rotatably attached to each end of said rigid bar, said resistant band including an elastic band having at least four spaced apart eyelets secured along a length of the elastic band by connectors, each of said S-hooks adapted to be hooked to an eyelets such that a length of the resistant band spans between said S-hooks, said rigid bar adapted to be raised when said exerciser raises each of said grip handles, wherein a resistance of said resistant band can be varied by the exerciser by disengaging an eyelet hooked on one of said S-hooks and engaging another eyelet with the S-hook thereby changing the length of the resistant band that spans between said S-hooks.

2. The exercise device as in claim 1 wherein said eyelets are spaced apart equidistantly from each other.

* * * * *